US011469508B1

(12) United States Patent
Parsche

(10) Patent No.: US 11,469,508 B1
(45) Date of Patent: Oct. 11, 2022

(54) COMMUNICATIONS DEVICE WITH ELECTRICALLY SMALL ANTENNA AND SETTABLE OPERATING CURVE AND RELATED METHOD

(71) Applicant: EAGLE TECHNOLOGY, LLC, Melbourne, FL (US)

(72) Inventor: Francis E. Parsche, Palm Bay, FL (US)

(73) Assignee: EAGLE TECHNOLOGY, LLC, Melbourne, FL (US)

( * ) Notice: Subject to any disclaimer, the term of this patent is extended or adjusted under 35 U.S.C. 154(b) by 0 days.

(21) Appl. No.: 17/331,924

(22) Filed: May 27, 2021

(51) Int. Cl.

| | |
|---|---|
| ***H01Q 9/04*** | (2006.01) |
| ***H01Q 1/42*** | (2006.01) |
| ***H01Q 5/314*** | (2015.01) |
| ***H01Q 1/24*** | (2006.01) |

(52) U.S. Cl.
CPC ..... *H01Q 9/0414* (2013.01); *H01Q 1/243* (2013.01); *H01Q 1/422* (2013.01); *H01Q 5/314* (2015.01)

(58) Field of Classification Search
CPC .. H01Q 9/04; H01Q 5/31; H01Q 1/24; H01Q 1/42
See application file for complete search history.

(56) References Cited

U.S. PATENT DOCUMENTS

| | | | | |
|---|---|---|---|---|
| 3,426,352 | A * | 2/1969 | Fenwick | H01Q 5/45 343/750 |
| 8,654,020 | B2 | 2/2014 | Kim et al. | |
| 8,743,009 | B2 | 6/2014 | Packer | |
| 9,812,780 | B2 | 11/2017 | Gaddi et al. | |
| 2006/0066488 | A1* | 3/2006 | Zhinong | H01Q 9/0421 343/702 |
| 2012/0050121 | A1 | 3/2012 | Kim et al. | |

FOREIGN PATENT DOCUMENTS

| | | |
|---|---|---|
| CN | 101356740 | 1/2009 |
| CN | 102005648 | 4/2011 |
| CN | 103780224 | 5/2014 |
| CN | 104377444 | 2/2015 |
| EP | 3050156 | 8/2016 |

(Continued)

OTHER PUBLICATIONS

L.J. Chu "Physical limitations of Omnidirectional Antennas" Journal of Applied Physics 19:Dec. 1948; pp. 1163-1175.

(Continued)

*Primary Examiner* — Andrea Lindgren Baltzell
(74) *Attorney, Agent, or Firm* — Allen, Dyer, Doppelt + Gilchrist, P.A.

(57) ABSTRACT

A communications device may include an RF device having an operating frequency range, and an antenna coupled to the RF device and being electrically small with respect to the operating frequency range of the RF device. The communications device may include an active capacitor coupled between the RF device and the antenna. The active capacitor may include a settable operating curve with a decreasing capacitance versus increasing frequency over a portion of the operating frequency range of the RF device. The communications device may further include a control circuit coupled to the active capacitor to set the settable operating curve.

23 Claims, 9 Drawing Sheets

(56) References Cited

FOREIGN PATENT DOCUMENTS

| | | |
|---|---|---|
| RU | 2169973 | 6/2001 |
| WO | WO9912231 | 3/1999 |

OTHER PUBLICATIONS

Harold A. Wheeler "The Wideband Matching Area for a Small Antenna" IEEE Transactions on Antennas;, vol. 31 Issue 32, pp. 365-367, Mar. 1983.

Price et al. "Comparison of barium strontium titanate varactors on magnesium oxide and alumina substrates" IEEE Wamicon 2011 Conference Proceedings, Clearwater Beach, FL, USA, 2011, pp. 1-5.

Sadat et al. "Breakdown Effects on MOS Varactors and VCO™ s" Proceedings of The 2003 IEEE International Frequency Control Symposium and PDA Exhibition, May 2003, Tampa, FL USA.

Albert Perry "Broadband Antenna Systems Realized From Active Circuit" https://core.ac.uk/download/pdf/36709754.pdf pp. 190.

Loghmannia et al. "Broadband Parametric Impedance Matching for Small Antennas Using the Bode-Fano Limit" IEEE Transactions on Antennas and Propagation;Jul. 26, 2019 https://arxiv.org/ftp/arxiv/papers/1907/1907.11683.pdf; pp. 13.

R.C. Hansen "Fundamental Limitations in Antennas" Proc. of The IEEE, vol. 69, No. 3, Feb. 1981, pp. 170-183; Abstract Only.

Harold A. Wheeler"Fundamental Limitations of Small Antennas" Proceeding of The IRE, Dec. 1947, pp. 1479-1483 (Stated 1.5X Directivity of Small Antennas) Abstract Only.

* cited by examiner

COMMUNICATIONS DEVICE WITH ELECTRICALLY SMALL ANTENNA AND SETTABLE OPERATING CURVE AND RELATED METHOD

TECHNICAL FIELD

The present disclosure relates to the field of communications, and, more particularly, to a wireless communications device and related methods.

BACKGROUND

Mobile communications devices have become an integral part of society over the last two decades. Mobile communications devices are deployed to government personnel, and emergency service providers. In some applications, the mobile communications device is handheld, but in other applications, the mobile communications device may be more bulky, yet still portable, such as a manpack radio, as available from the L3Harris Corporation of Melbourne, Fla. The typical mobile communications device includes an antenna, and a transceiver coupled to the antenna. The transceiver and the antenna cooperate to transmit and receive communications signals.

Before transmission, the typical mobile communications device modulates digital data onto an analog signal. As will be readily appreciated by the skilled person, there is a plurality of modulations available for most applications. For most communications devices, the transmitted and received signals are spectrally limited. In other words, the communications device operates within an expected frequency range, such as the ultra high frequency (UHF) range or the very high frequency (VHF) range. Because of the known operational characteristic, the communications device is usually designed to operate optimally within the expected frequency range. Nevertheless, as communications devices have become more robust in the included feature set, some applications demand operating within multiple frequency bands, i.e. multi-band devices.

In some multi-band devices, the transmit/receive architecture may comprise a plurality of paths with respective amplifiers/receivers and antennas. In other applications, there may be a common transmit and receive path with a single antenna. In these latter applications, it can be challenging to optimize the common transmit and receive path to perform optimally in each of the operational frequency bands.

In particular, it may be problematic to design optimum impedance matching for the common antenna across each operational frequency band. One approach to these design hurdles is to sacrifice optimal performance in all bands for an architecture with passable performance in the operational frequency bands. These design hurdles can be more troublesome in communications devices that are "electrically short", i.e. where the antenna length is short relative to a resonant length at the operational frequency ranges.

SUMMARY

Generally, a communications device may include an RF device having an operating frequency range, and an antenna coupled to the RF device and being electrically small with respect to the operating frequency range of the RF device. The communications device may comprise an active capacitor coupled between the RF device and the antenna. The active capacitor may have a settable operating curve with a decreasing capacitance versus increasing frequency over at least a portion of the operating frequency range of the RF device. The communications device may further comprise a control circuit coupled to the active capacitor to set the settable operating curve thereof.

In some embodiments, the control circuit may comprise a direct current (DC) biasing source. The control circuit may comprise at least one RF filter device associated with the DC biasing source. The active capacitor may comprise a pair of spaced apart electrodes and a metal oxide dielectric layer between the pair of spaced apart electrodes. The active capacitor may comprise a pair of spaced apart electrodes and a titanate layer between the pair of spaced apart electrodes.

Also, the active capacitor may comprise a planar configuration of a pair of spaced apart electrodes and a metal oxide dielectric layer between the pair of spaced apart electrodes. The communications device may also comprise an RF coaxial feed coupled between the RF device and the antenna. The RF coaxial feed may comprise an inner conductor coupled to the antenna, and an outer conductor surrounding the inner conductor and coupled to a reference voltage. The device may comprise a ground plane, and the antenna may include a curved conductor extending outwardly from the ground plane. More specifically, for the electrically small antenna, $r\lambda/(2\pi)$ is $<<1$, r is a radius of the antenna, and $\lambda$ is a wavelength of the operating frequency range of the RF device.

Another aspect is directed to a method for making a communications device. The method may comprise coupling an antenna to an RF device having an operating frequency range, the antenna being electrically small with respect to the operating frequency range of the RF device, and coupling an active capacitor between the RF device and the antenna. The active capacitor may have a settable operating curve with a decreasing capacitance versus increasing frequency over at least a portion of the operating frequency range of the RF device. The method may comprise coupling a control circuit to the active capacitor to set the settable operating curve thereof.

DETAILED DESCRIPTION

Figure 1:
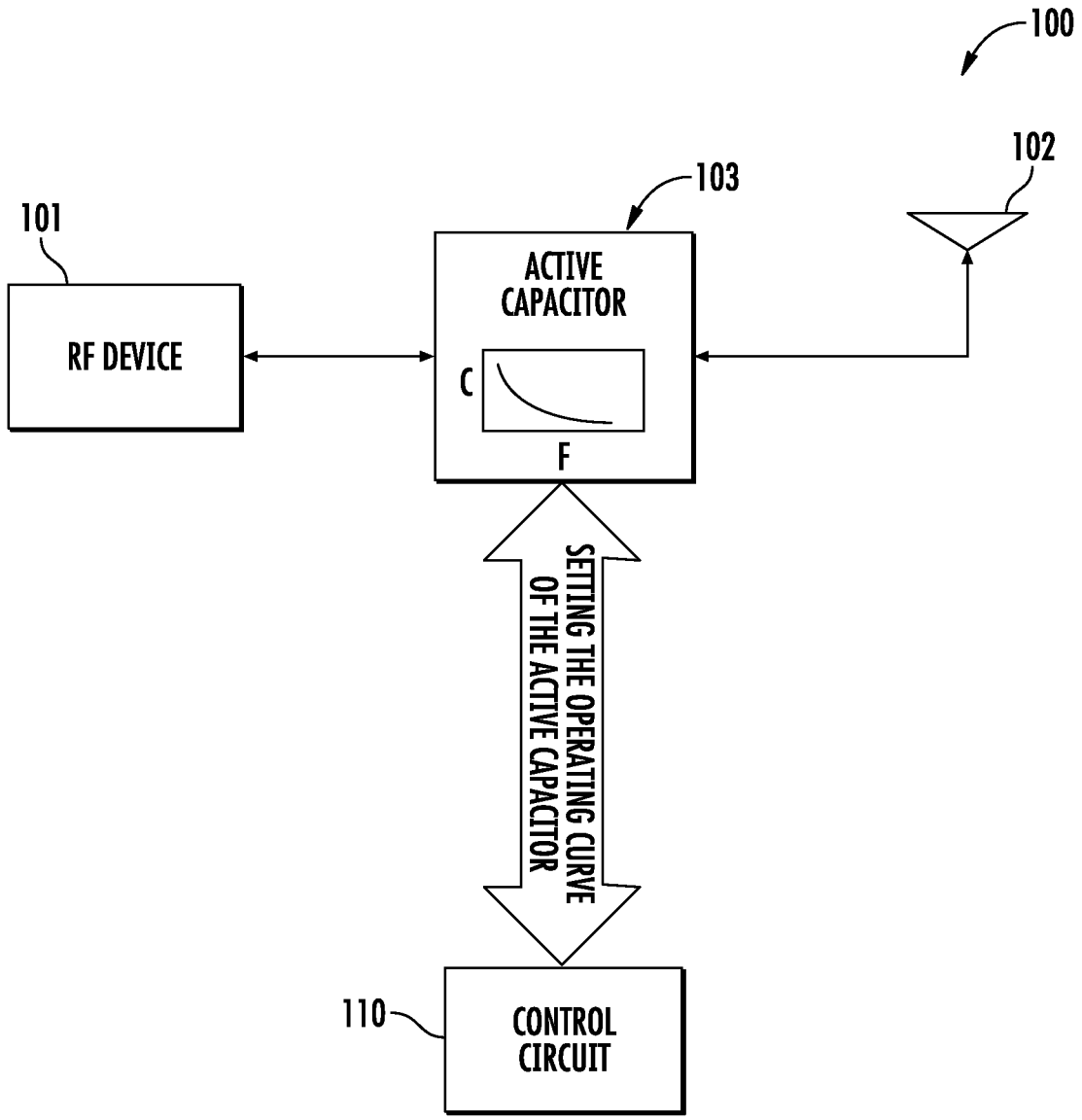
FIG. 1 is a schematic diagram of a first example embodiment of a communications device, according to the present disclosure.

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout, and base 100 reference numerals are used to indicate similar elements in alternative embodiments.

Electrically small antennas are made with combinations of the good insulators and good conductors. At present, nature provides excellent insulators and relatively lessor performing room temperature conductors. When small enough, many antennas may become inefficient due to conductor loss. For electrically small antennas that are not self-resonant, a loading capacitor may be used. This makes a loop preferential in some instances for efficiency's sake, although the loop has offsetting issues of lower radiation resistance than the dipole.

Electrically small antennas may take many forms, but the typical small antennas are the line and circle Euclidian shapes corresponding to the dipole and loop antenna respectively. While the dipole diverges electric current and the loop curls electric current, hybrid loop-dipole electrically small antennas can be formed by coils, such as the helix-shaped antenna. In the helix-shaped antenna, curl and divergence are both present, and the ratio may be adjusted by coil height to diameter. The coil may be wound to be self-resonant as well.

Physics may limit the electrically small antenna fixed tuned radiation bandwidth. One theory is the Chu Limit as described in the reference "Physical limitations of Omnidirectional Antennas", Chu, L. J. (December 1948), Journal of Applied Physics 19: 1163-1175, which is called out as a reference herein. The Chu Bandwidth Limit equation may $Q \geq 1/k^3r^3+1/kr$, where Q is a dimensionless number relating to bandwidth, k is the wave number$=2\pi/\lambda$, and r is the radius of a the smallest spherical analysis envelope enclosing the antenna in meters. The 3 dB antenna radiation bandwidth in turn is equal to 200/Q. An example according to Chu is the 3 dB radiation bandwidth, the electrically small antenna fitting in an analysis sphere of radius $\lambda/20$: the Chu 3 dB radiation bandwidth of this size antenna cannot exceed 16%. A normal mode helix antenna (small coil) might in practice provide about 25% of the Chu's Limit fixed tuned 3 dB radiation bandwidth although this varies with factors of LC ratio, dissipative loss, coil shape etc. Chu discusses the instance of a lossless linearly polarized fixed tuned antenna having a single gain maxima, e.g., the quadratic frequency response as is most common. The reason for the Chu bandwidth limit is the reactive load impedance that occurs away from a narrow nonreactive resonance frequency at small antenna band center. This circuit reactance, the associated reflections and the voltage standing wave ratio (VSWR) is caused by unequal charging of the antenna reactive near fields, electric and magnetic, and the limited radiation resistance that electrically small antennas make. Amperes Circuit Law and Gauss's Law assure non-radiating near field development around the electrically small antenna. Electrical charge must be separated to drive the antenna and electric current conveyed on the conductive antenna structure to cause the radiation. Positively, the size of the pattern bandwidth of electrically small antennas is large so the direction of radiation does not change with frequency.

Frequency response shapes other than quadratic can be obtained by introducing multiple tuning to the electrically small antenna. This increases instantaneous radiation bandwidth provided a passband ripple can be accepted. Additional resonances that cause multiple tuning may be provided by a compensation network containing resonant circuits. Multiple tuning can provide a rippled passband with the radiation peaks adjacent in frequency as is similar to the controlled ripple Chebyschev response common in filters. For example, the paper "The Wideband Matching Area For A Small Antenna", Harold A. Wheeler, IEEE Transactions On Antennas, Vol. 31 Issue 32, pp 365-367, March 1983 is called out as reference in this regard, the contents of which are hereby incorporated by reference in their entirety. The utility of multiple tuning is limited however by increasing complexity, losses from the energy ringing back and forth in the compensation network, and by increased sensitivity to manufacturing tolerances. An infinite number of passband ripples only provides a $3\pi$ increase over the single tuned quadratic case 3 dB instantaneous radiation bandwidth, and then an impractical super precision may be required for actual implementation. Thus, the utility of multiple tuning the small antenna is not without limits.

Loss may be introduced to the electrically small antenna to increase 3 dB radiation bandwidth in exchange for reduced radiation efficiency. In the introduced loss approach, more realized gain bandwidth occurs, but at lower realized gain levels. Further, large amounts of loss may be required for modest radiation bandwidth increase. In transmit applications, and in receive applications above 30 MHz, there may be few uses for a lossy antenna of low efficiency and realized gain.

U.S. Pat. No. 8,743,009 to Packer discloses an approach to an antenna system. Here, a device reduces a length of an antenna and involves an arrangement which includes an orthogonal antenna feed. The antenna includes a radiating element with a length extending along an axis. The orthogonal feed arrangement permits recovery of a portion of the spatial volume comprising the antenna, which is normally used for antenna matching circuitry. An end portion of the radiating element is chosen to be helically shaped and includes a radio frequency (RF) feed gap.

In spite of these typical approaches, improved means to tune electrically small antennas may be helpful. In particular, a method to increase the instantaneous (fixed tuned) radiation bandwidth of electrically small antennas may be helpful.

Figure 2A:
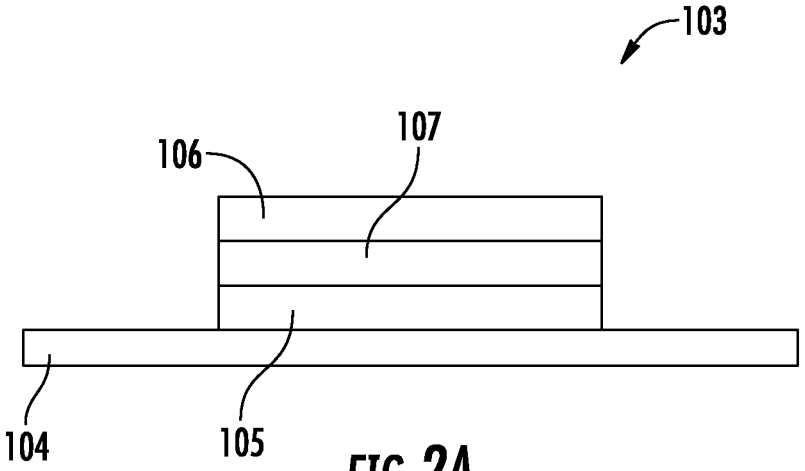
FIG. 2A is a schematic side view of an active capacitor from the communications device of FIG. 1.

Referring initially to FIGS. 1 and 2A, a communications device 100 is now described. The communications device 100 may provide an approach to the issue of electrically small antennas. In particular, in electrically small antennas, their instantaneous (fixed tuned) radiation bandwidth may be small. This limitation is known as the Chu-Harrington Limit. It occurs because energy reflects back out of the antenna, as VSWR and this is due to antenna reactance change with frequency. In typical RF design, antenna size may be a concern in communications; largely, since most users desire smaller devices, antenna size may be necessarily small.

Some typical approaches to electrically small antennas include: added loss, combined antenna responses adding ripple to the signal, predistortion of the applied signal in frequency or time, hybrid power dividers with reject loads, "space filling antennas" (i.e. really big antennas), fractal antennas at large size, Linville reactance inverting amplifiers, and multiple tuned rippled antenna passbands. These approaches may have the drawbacks of reducing signal strength, providing only a limited bandwidth increase, distorting the signal, increasing antenna voltages to arcing, and/or being lossy.

The communications device 100 illustratively includes an RF device 101 having an operating frequency range. For example, the RF device may comprise a wireless transceiver, a wireless transmitter, or a wireless receiver operating in the VHF, UHF frequency ranges. Of course, these frequency ranges are exemplary and other frequency ranges are within the scope of this disclosure.

The communications device 100 illustratively includes an antenna 102 coupled to the RF device 101 and being electrically small with respect to the operating frequency range of the RF device. In some embodiments, the antenna 102 is also narrowband in spectral operation (i.e. narrowband comprising an instantaneous 3 dB radiation bandwidth of less than say less 20 percent). The antenna 102 may be defined as an electrically small antenna based upon the following relational formula:

$$r \leq \lambda/2\pi; \quad (1)$$

where r is a radius in meters of an analysis sphere enclosing the antenna 102, and where λ is a wavelength of the operating frequency range of the RF device 101 in meters.

The communications device 100 illustratively includes an active capacitor 103 coupled between the RF device 101 and the antenna 102. In particular, the active capacitor 103 is coupled in series with the RF device 101 and the antenna 102, but may be coupled in parallel with these devices in other embodiments. The active capacitor 103 has a settable operating curve with a decreasing capacitance versus increasing frequency over at least a portion of the operating frequency range of the RF device 101. Of course, in some embodiments, the settable operating curve with the decreasing capacitance versus increasing frequency is over the entirety of the operating frequency range of the RF device 101

In particular, the active capacitor 103 may provide for instantaneous broad radiation bandwidth performance. The active capacitor comprises a so-called "negative capacitor", having negative slope or falling capacitance with rising frequency. As will be appreciated, an ideal capacitor has a capacitance that is constant with frequency, and a real world capacitor has a capacitance that increases slightly with frequency due to distributed inductance in the capacitor structure or connection structure.

As shown in FIG. 2A, in this embodiment, the active capacitor 103 comprises a substrate 104, a pair of spaced apart electrodes 105, 106, and a metal oxide dielectric layer 107 (or a titanate layer) between the pair of spaced apart electrodes. The metal oxide dielectric layer 107 may be a metal rich oxide dielectric layer containing a proportion of unoxidized metal. The lower spaced apart electrode 105 is carried by the substrate 104. Of course, this illustrated active capacitor 103 is exemplary and other embodiments of the active capacitor can be used.

In some embodiments, the pair of spaced apart electrodes 105, 106, and the metal oxide dielectric layer 107 may comprise thin film layers having a thickness in the range of 150-1000 Angstroms. Each of the pair of spaced apart electrodes 105, 106 may comprise one or more of gold, copper, silver, and aluminum. The active capacitor 103 may operate by voltage induced metal-insulator transition in the metal oxide dielectric layer 107 (i.e. an electrolytic reaction). In some embodiments, the pair of spaced apart electrodes 105, 106, and the metal oxide dielectric layer 107 may be fabricated by thermionic deposition of a pure metal in an oxygen containing atmosphere, for example. Sputtering a metallic target may also provide a fabrication method for the metal rich metal oxide dielectric layer 107.

Each of the pair of spaced apart electrodes 105, 106 may comprise one or more of barium, strontium, titanate, vanadium, magnesium, aluminum, and metal oxide, such as barium strontium titanate. In some embodiments, the active capacitor 103 may comprise a barium strontium titanate varactor, as disclosed in: T. Price, T. Weller, Y. Shen and X. Gong, "Comparison of barium strontium titanate varactors on magnesium oxide and alumina substrates," IEEE WAMICON 2011 Conference Proceedings, Clearwater Beach, Fla., USA, 2011, pp. 1-5, the contents of which are hereby incorporated by reference in their entirety. In particular, the "MgO 7 Finger" trace in FIG. 5 of the Price et al. reference curves depicts a region with falling capacitance with rising frequency. In other embodiments, the active capacitor may comprise a MIM474A3 model capacitor, as available from Eclipse Energy Systems, Inc. of St. Petersburg, Fla.

Figure 9:
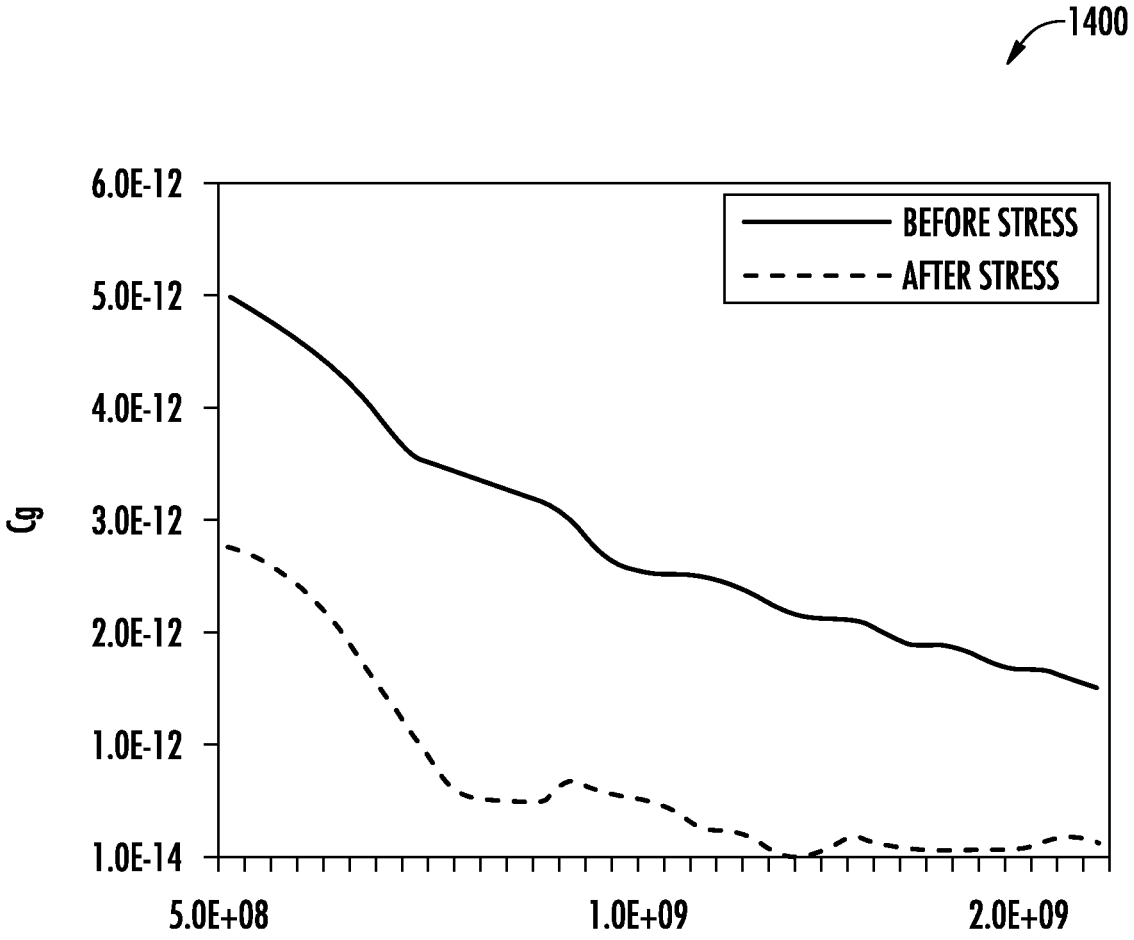
FIG. 9 (PRIOR ART)
FIG. 9 is a diagram of capacitance decreasing with rising frequency for an oxide breakdown device, according to the prior art.

Referring briefly to FIG. 9, a diagram 1400 is shown (FIG. 7 from the Sadat et al. reference) from the reference "Breakdown Effects On MOS Varactors and VCO's", Anwar Sadat, Hong Yang, Enjun Xiao, Jians S. Wong, Proceedings Of The 2003 IEEE International Frequency Control Symposium and PDA Exhibition, May 2003, Tampa, Fla. USA. Here, a metal oxide component exhibits a dropping capacitance with rising frequency due to gate oxide breakdown. Metal oxide depositions are thus suited to providing a needed dropping capacitance with rising frequency.

The communications device 100 illustratively comprises a control circuit 110 coupled to the active capacitor 103 to set the settable operating curve of the active capacitor. In some embodiments (FIGS. 3-4), the control circuit 110 may comprise a DC biasing source configured to provide a constant DC voltage between 0-25 Volts. The control circuit 110 may selectively alter the negative slope performance of the active capacitor 103. In some embodiments, the control circuit 110 may change the settable operating curve in real-time based upon operational characteristics (i.e. the DC bias voltage selectively changes). In other embodiments, the control circuit 110 may be factory programmed to set the settable operating curve in a fixed fashion.

The RF device 101 provides at least three modes of operation: 1) a broad banding mode by extending the instantaneous radiation bandwidth about a fixed center frequency of operation; 2) a tuning mode by changing the center frequency of operation/tuning; and 3) a combination mode of the broad banding and tuning modes.

In the broad banding mode of operation, the control circuit 110 applies a DC biasing voltage, after initial adjustment, that is held constant over time. The value of that constant DC voltage sets the capacitance versus frequency response of the RF device 101 and is set to compensate for the reactance versus frequency response of the antenna 102. Thus, the magnitude of the reactance of the RF device 101 is equal to that of the magnitude of the reactance of the antenna 102; the sign of the RF device 101 reactance is opposite that of the sign of the antenna 102 driving reactance; and the reactance slope versus frequency of the RF device 101 is reciprocal of the antenna 102. So, the RF device 101 may be a force resonating component for the antenna 102 that accomplishes instantaneous radiation bandwidth increase by being the resonating capacitance value required over a range of frequencies all at once. RF currents swing back and forth between the RF device 101 and the antenna 102 with the AC cycle. The RF device 101 also provides the necessary work function to force the reflected energy back into the antenna 102 as the RF device is an active component supplied with DC power. The RF device 101 bucks the antenna reflected energy and the more away from frequency band center the more the reflected energy is forced back into the antenna 102.

The natural uncompensated frequency response of the antenna 102 is in this example quadratic, although other antenna 102 responses may be accommodated. Quadratic means the frequency response of the antenna 102 may obey the quadratic equation, although the antenna 102 is not so limited as to a quadratic only response. A quadratic response antenna has a single radiation intensity peak with additional peaks at harmonics and obeys the equation $f=1/\sqrt{2\pi LC}$ where f=the antenna resonant frequency or frequency of peak radiation intensity, L=the inductance present in the antenna structure, and C=the capacitance present in the antenna structure. The frequency versus capacitance responses of the RF device 101 may advantageously include a $1/f^2$ response needed to compensate the antenna 102 response to increase bandwidth.

Another aspect is directed to a method for making a communications device 100. The method comprises coupling an antenna 102 to an RF device 101 having an operating frequency range, the antenna being electrically small with respect to the operating frequency range of the RF device, and coupling an active capacitor 103 between the RF device and the antenna. The active capacitor 103 has a settable operating curve with a decreasing capacitance versus increasing frequency over at least a portion of the operating frequency range of the RF device 101. The method comprises coupling a control circuit 110 to the active capacitor 103 to set the settable operating curve of the active capacitor.

Figure 2B:
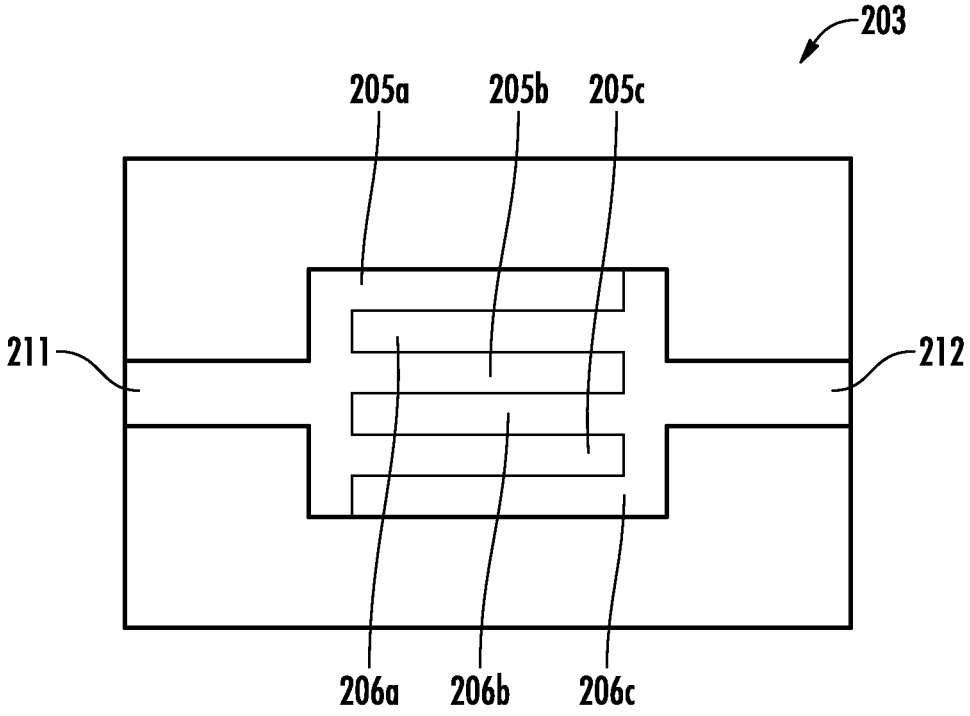
FIG. 2B is a schematic top plan view of the active capacitor from a second example embodiment of communications device.

Referring now additionally to FIG. 2B, another embodiment of the active capacitor 203 is now described. In this embodiment of the active capacitor 203, those elements already discussed above with respect to FIGS. 1-2A are incremented by 100 and most require no further discussion herein. This embodiment differs from the previous embodiment in that this active capacitor 203 illustratively includes a planar configuration of a pair of spaced apart electrodes 205*a*-205*c*, 206*a*-206*c* and a metal oxide dielectric layer 207 between the pair of spaced apart electrodes. As shown, the planar pair of spaced apart electrodes 205*a*-205*c*, 206*a*-206*c* are interdigitated. The active capacitor 203 comprises first and second contacts 211, 212 respectively coupled to the interdigitated fingers of the planar pair of spaced apart electrodes 205*a*-205*c*, 206*a*-206*c*.

Figure 3:
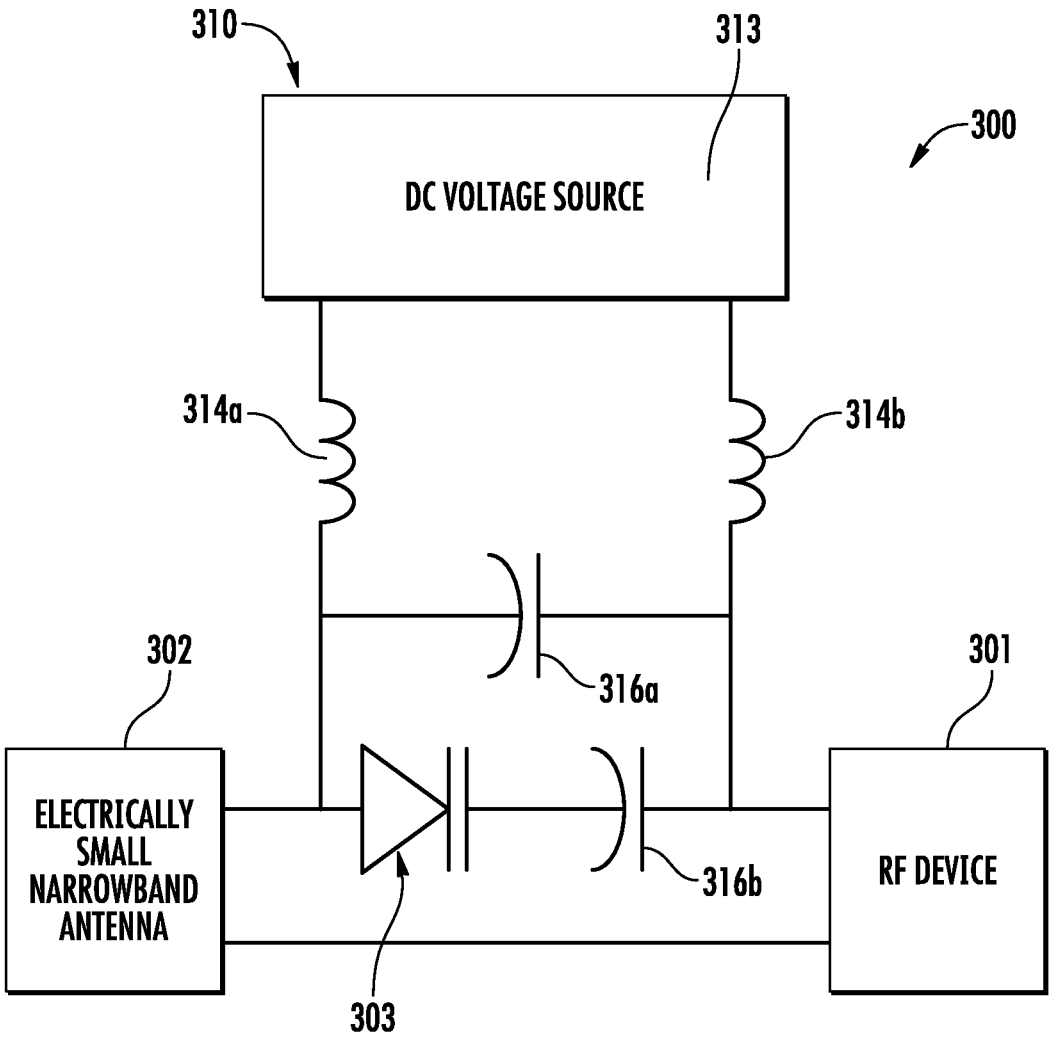
FIG. 3 is a schematic diagram of a third example embodiment of the communications device, according to the present disclosure.

Referring now additionally to FIG. 3, another embodiment of the communications device 300 is now described. In this embodiment of the communications device 300, those elements already discussed above with respect to FIGS. 1-2A are incremented by 200 and most require no further discussion herein. This embodiment differs from the previous embodiment in that this communications device 300 illustratively includes the control circuit 310 comprising a DC biasing source 313 configured to provide a constant DC voltage between 0-25 Volts. Here, the control circuit 310 illustratively includes first and second RF filter devices 314*a*-314*b* associated with the DC biasing source 313. The first and second RF filter devices 314*a*-314*b* each comprises an inductor (i.e. RF choke inductors). The control circuit 310 illustratively includes scaling capacitors 316*a*-316*b* to adjust the magnitude and range of the capacitive reactance applied to the antenna 302 by the active capacitor 303. The control circuit 310 may include other reactive components, such as inductors (not shown) in some instances.

Figure 4:
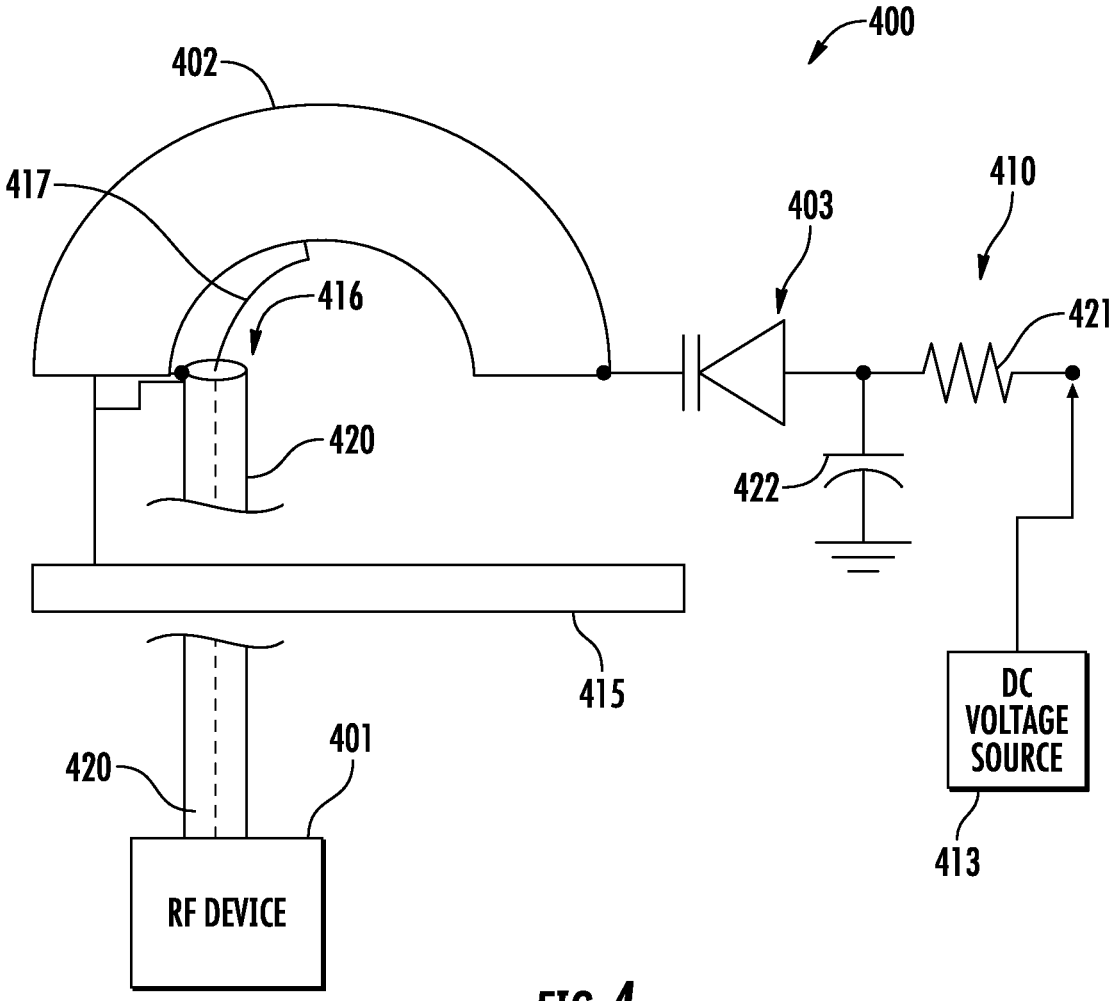
FIG. 4 is a schematic diagram of a fourth example embodiment of the communications device, according to the present disclosure.

Referring now additionally to FIG. 4, another embodiment of the communications device 400 is now described. In this embodiment of the communications device 400, those elements already discussed above with respect to FIGS. 1-2A & 3 are incremented by 300 and most require no further discussion herein. This embodiment differs from the previous embodiment in that this communications device 400 illustratively includes a ground plane 415, and a curved loop antenna 402 coupled to the ground plane and extending upwardly from the ground plane. Also, for example, the active capacitor 403 comprises a MIM474A3 model capacitor, as available from Eclipse Energy Systems, Inc. of St. Petersburg, Fla.

In particular, the communications device 400 illustratively includes an RF coaxial feed 416 coupled between the RF device 401 and the antenna 402. The RF coaxial feed 416 comprises an inner conductor 417 coupled to the antenna 402, and an outer conductor 420 surrounding the inner conductor and coupled to a reference voltage (i.e. the ground plane 415). Also, the control circuit 410 illustratively comprises a current limiting resistor 421 coupled between the DC biasing source 413 and the active capacitor 403, and a capacitor 422 coupled between the current limiting resistor and the reference voltage. In this embodiment, the falling capacitance of the active capacitor 403 with rising frequency may compensate for the increasing inductive reactance with the curved loop antenna 402. Thus, an instantaneously broadband radiation bandwidth may be provided by the curved loop antenna 402.

Figure 5:
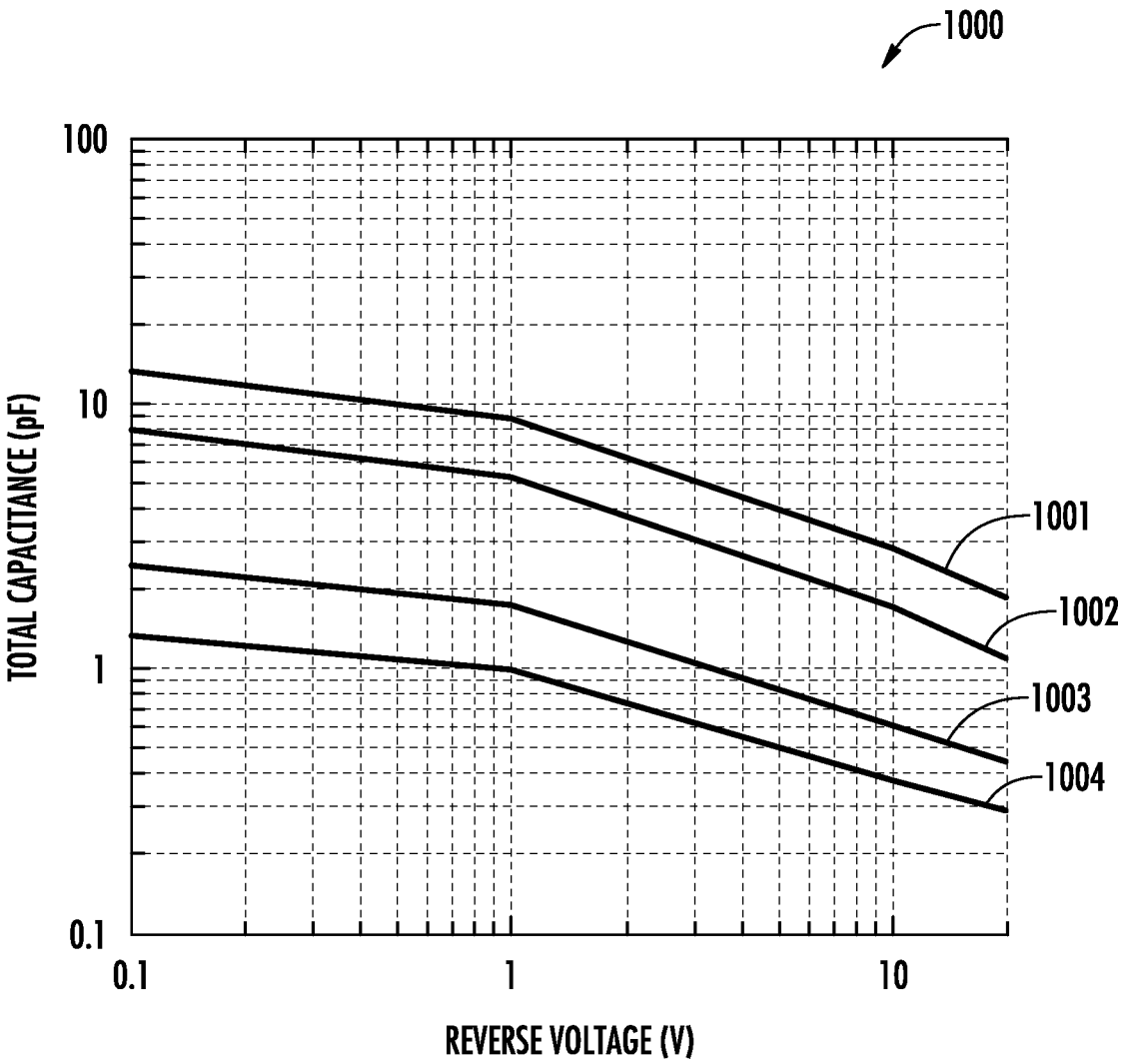
FIG. 5 is a diagram of capacitance over bias voltage in the fourth example embodiment of the communications device.

Referring now additionally to FIG. 5, a diagram 1000 shows total capacitance over bias voltage for four example embodiments (traces 1001, 1002, 1003, 1004) of the active capacitor 103, 203, 303, 403. For traces 1001, 1002, 1003, 1004, the active capacitor 403 respectively comprises a MA46H073, MA46H072, MA46H071, and MA46H070 model varactor, each available from MACOM Technology Solutions of Lowell, Mass. In the diagram 1000, there is 2 pf to 0.3 pf capacitance range or 6.7 to 1 capacitance variation or $\sqrt{6.7}=2.6$ to 1 antenna tuning range.

Figure 6:
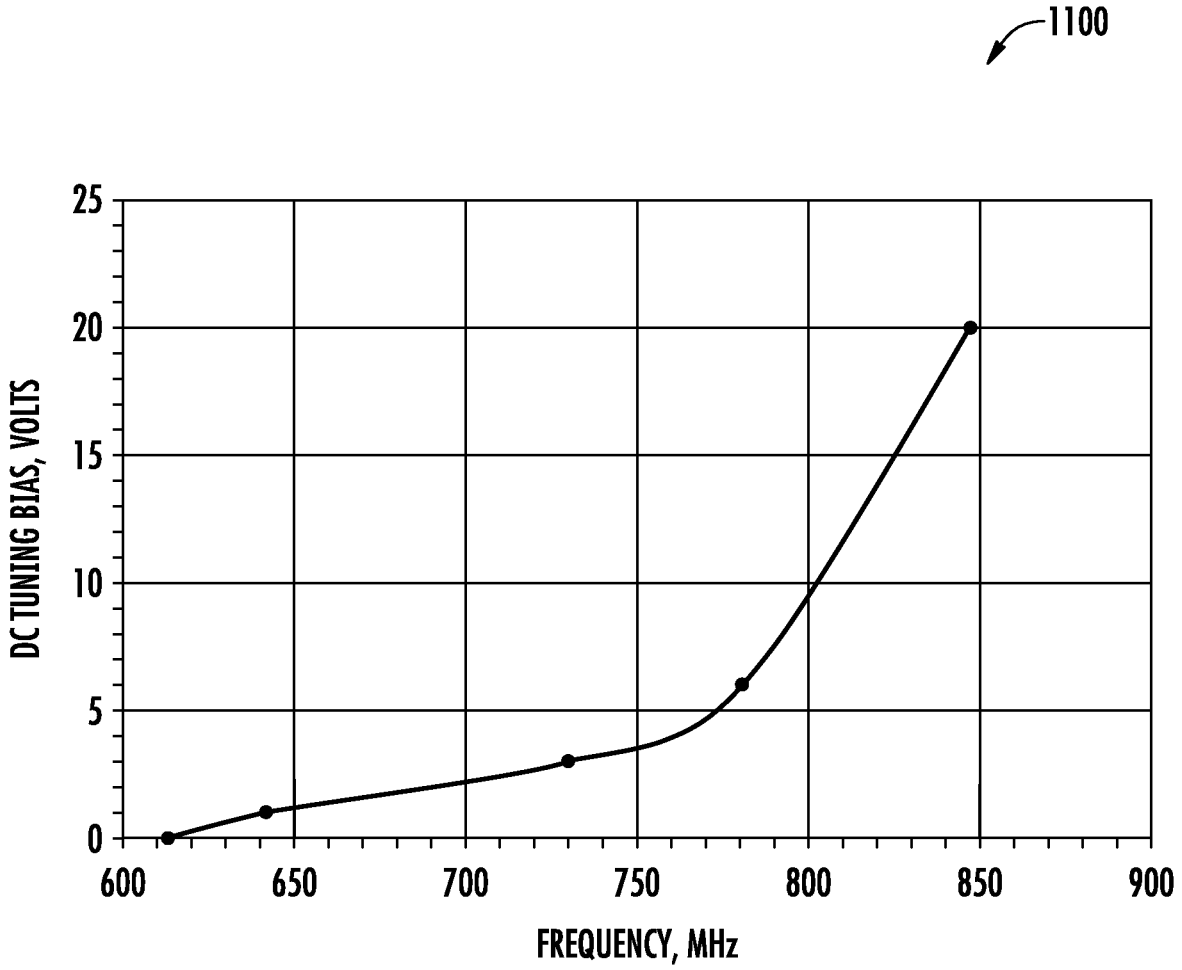
FIG. 6 is a diagram of the tuning response in the fourth example embodiment of the communications device.

Referring now additionally to FIG. 6, a diagram 1100 shows tuning response of the example embodiment of the communications device 400. Here, the flexibility of the communications device 400 is shown as the operating frequency can be varied by adjusting the DC bias voltage from 0-25 Volts.

Figure 7:
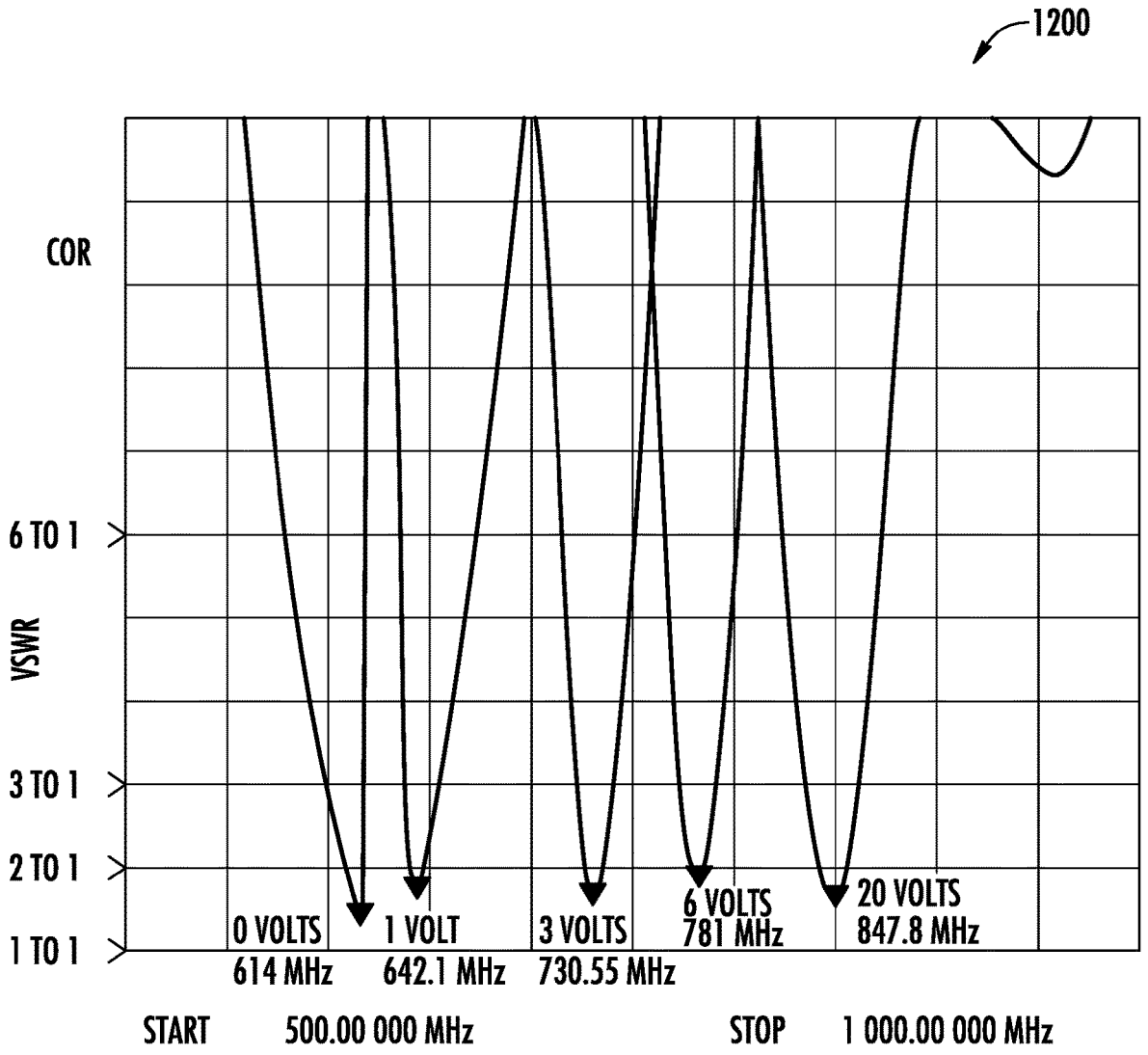
FIG. 7 is a diagram of the voltage standing wave ratio in the fourth example embodiment of the communications device.

Referring now additionally to FIG. 7, a diagram 1200 shows VSWR of the example embodiment of the communications device 400. The diagram 1200 shows VSWR at 614 MHz with a 0 volt bias voltage; 642 MHz with a 1 V bias voltage; 730.55 MHz with a 3 V bias voltage; 781 MHz with a 6 V bias voltage; and 847.8 MHz with a 20 V bias voltage. Advantageously, the example embodiment of the communications device 400 provides for low VSWR at these operational frequencies.

Figure 8:
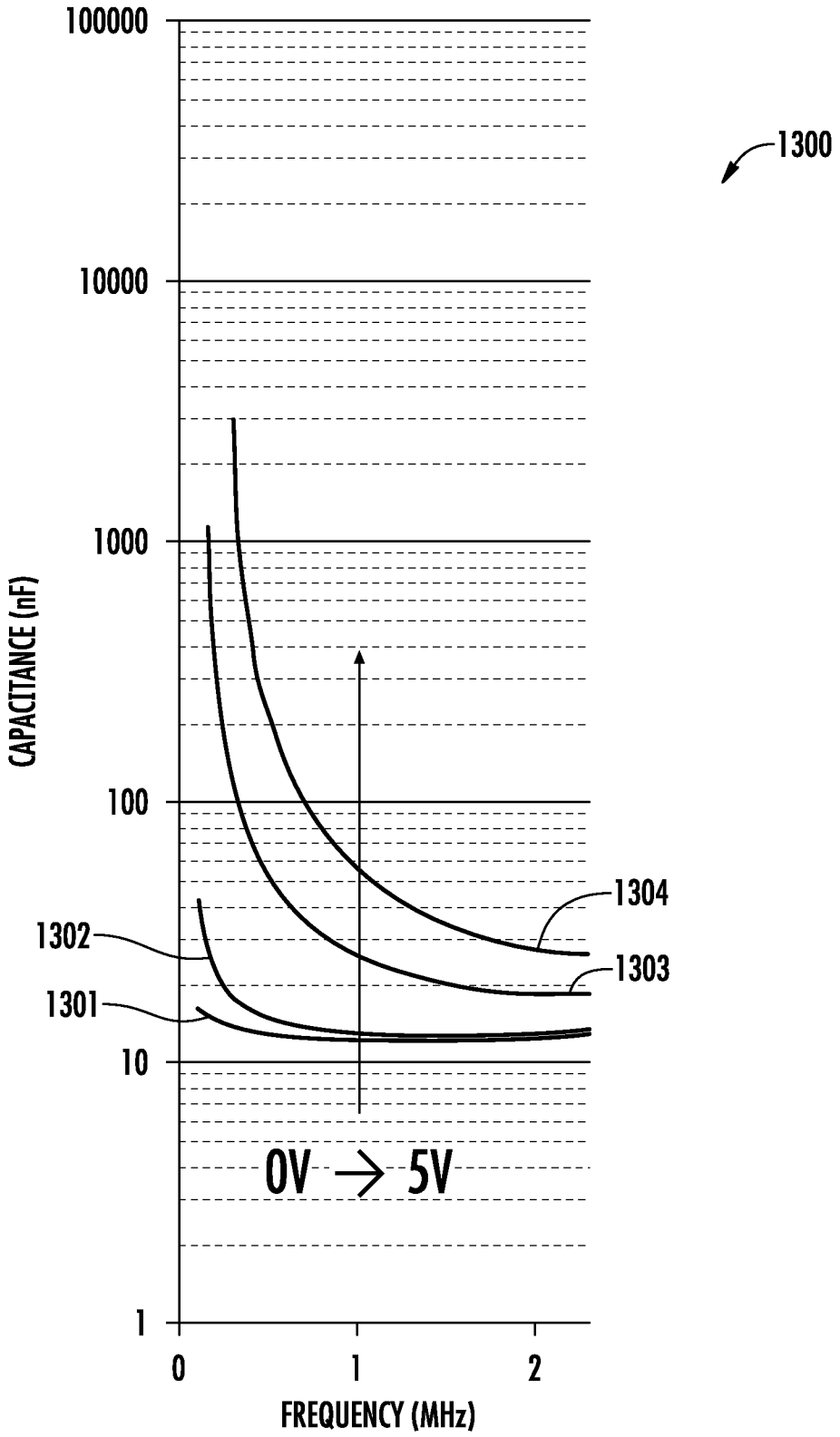
FIG. 8 is a diagram of the negative slope behavior in the active capacitor of the fourth example of the communications device.

Referring now additionally to FIG. 8, a diagram 1300 shows capacitance over frequency for the embodiment of the active capacitor 403. Again, the active capacitor 403 comprises the MIM474A3 model capacitor. In particular, traces 1301, 1302, 1303, 1304 respectively relate to applying biasing voltages of 0 V, 3 V, 4 V, 5 V for the active capacitors 403. As shown, each of the biasing configurations possesses a negative slope performance characteristic for only a portion of the usable spectrum. In particular, the biasing voltages of 4 V and 5 V provide the most usable spectrum with the negative slope characteristic.

The RF device 401 provides a capacitive reactance and is immediately suitable for force resonating and broad banding electrically small loop antennas, which characteristically have reactive driving impedances below natural resonance. The RF device 401 is not so limited however as to being only useful for resonating and broad banding the electrically small loop. An electrically small dipole (not shown) can be made to provide an inductive driving reactance below natural resonance by folding the dipole structure. An inductor can be placed in series with the RF device 401 as another means of resonating capacitive antenna loads.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

The invention claimed is:

1. A communications device comprising:

a radio frequency (RF) device having an operating frequency range;

an antenna coupled to said RF device and being electrically small with respect to the operating frequency range of said RF device;

an active capacitor coupled between said RF device and said antenna, said active capacitor having a settable operating curve with a decreasing capacitance versus increasing frequency over at least a portion of the operating frequency range of said RF device; and a control circuit coupled to said active capacitor to set the settable operating curve thereof.

2. The communications device of claim 1 wherein said control circuit comprises a direct current (DC) biasing source.

3. The communications device of claim 2 wherein said control circuit comprises at least one RF filter device associated with said DC biasing source.

4. The communications device of claim 1 wherein said active capacitor comprises a pair of spaced apart electrodes and a metal oxide dielectric layer between said pair of spaced apart electrodes.

5. The communications device of claim 1 wherein said active capacitor comprises a pair of spaced apart electrodes and a metal oxide dielectric layer between said pair of spaced apart electrodes in a planar configuration.

6. The communications device of claim 1 wherein said active capacitor comprises a pair of spaced apart electrodes and a titanate layer between said pair of spaced apart electrodes in a planar configuration.

7. The communications device of claim 1 comprising an RF coaxial feed coupled between said RF device and said antenna.

8. The communications device of claim 7 wherein said RF coaxial feed comprises an inner conductor coupled to said antenna, and an outer conductor surrounding said inner conductor and coupled to a reference voltage.

9. The communications device of claim 1 comprising a ground plane; and wherein said antenna comprises a curved conductor extending outwardly from the ground plane.

10. The communications device of claim 1 wherein $r\lambda/(2\pi)$ is $<<1$; wherein r is a radius of said antenna; and wherein $\lambda$ is a wavelength of the operating frequency range of said RF device.

11. A communications device comprising:

a radio frequency (RF) device having an operating frequency range;

an antenna coupled to said RF device and being electrically small with respect to the operating frequency range of said RF device;

an active capacitor coupled between said RF device and said antenna, said active capacitor having a settable operating curve with a decreasing capacitance versus increasing frequency over at least a portion of the operating frequency range of said RF device, said active capacitor comprising a pair of spaced apart electrodes and a metal oxide dielectric layer between said pair of spaced apart electrodes; and a direct current (DC) biasing source coupled to said active capacitor to set the settable operating curve thereof.

12. The communications device of claim 11 comprising at least one RF filter device associated with said DC biasing source.

13. The communications device of claim 11 wherein said pair of spaced apart electrodes and said metal oxide dielectric layer are arranged in a planar configuration.

14. The communications device of claim 11 comprising an RF coaxial feed coupled between said RF device and said antenna.

15. The communications device of claim 14 wherein said RF coaxial feed comprises an inner conductor coupled to said antenna, and an outer conductor surrounding said inner conductor and coupled to a reference voltage.

16. The communications device of claim 11 further comprising a ground plane; and wherein said antenna comprises a curved conductor extending outwardly from said ground plane.

17. The communications device of claim 11 wherein $r\lambda/(2\pi)$ is $<<1$; wherein r is a radius of said antenna; and wherein $\lambda$ is a wavelength of the operating frequency range of said RF device.

18. A method for making a communications device comprising:

coupling an antenna to a radio frequency (RF) device having an operating frequency range, the antenna being electrically small with respect to the operating frequency range of the RF device;

coupling an active capacitor between the RF device and the antenna, the active capacitor having a settable operating curve with a decreasing capacitance versus increasing frequency over at least a portion of the operating frequency range of the RF device; and coupling a control circuit to the active capacitor to set the settable operating curve thereof.

19. The method of claim 18 wherein the control circuit comprises a direct current (DC) biasing source.

20. The method of claim 19 wherein the control circuit comprises at least one RF filter device associated with the DC biasing source.

21. The method of claim 18 wherein the active capacitor comprises a pair of spaced apart electrodes and a metal oxide dielectric layer between the pair of spaced apart electrodes.

22. The method of claim 18 wherein the active capacitor comprises a pair of spaced apart electrodes and a titanate layer between the pair of spaced apart electrodes.

23. The method of claim 18 comprising coupling an RF coaxial feed between the RF device and the antenna.

* * * * *